US011730274B1

(12) United States Patent
Gibree

(10) Patent No.: US 11,730,274 B1
(45) Date of Patent: Aug. 22, 2023

(54) CHAIR AND ATTACHABLE OTTOMON THAT CONVERTS TO A SLIDE

(71) Applicant: Delta Enterprise Corp., New York, NY (US)

(72) Inventor: Steven Gibree, Narragansett, RI (US)

(73) Assignee: Delta Enterprise Corp., New York, NY (US)

( * ) Notice: Subject to any disclaimer, the term of this patent is extended or adjusted under 35 U.S.C. 154(b) by 0 days.

(21) Appl. No.: 17/842,059

(22) Filed: Jun. 16, 2022

(51) Int. Cl.

| | |
|---|---|
| ***A47C 20/00*** | (2006.01) |
| ***A47C 17/04*** | (2006.01) |
| ***A47C 13/00*** | (2006.01) |
| ***A63G 21/04*** | (2006.01) |
| ***A63G 21/02*** | (2006.01) |

(52) U.S. Cl.
CPC ..... *A47C 13/00* (2013.01); *A63G 21/02* (2013.01)

(58) Field of Classification Search
CPC ..... A47C 17/045; A47C 20/027; A47C 3/16; A47C 13/00; A47C 20/021; Y10S 297/01; Y10S 5/953
See application file for complete search history.

(56) References Cited

U.S. PATENT DOCUMENTS 726,028 A 4/1903 Chase
2,997,724 A * 8/1961 Heumann ..... A47C 17/132 5/18.1
3,469,882 A * 9/1969 Larsen ..... A47C 17/045 297/118
3,555,581 A * 1/1971 Friant ..... A47C 3/16 5/722
3,561,757 A 2/1971 Schillig
3,736,023 A 5/1973 Lyons
3,740,774 A * 6/1973 Powell ..... A47C 27/22 5/28
3,742,526 A * 7/1973 Lillard ..... A47C 17/045 5/28
3,902,759 A * 9/1975 Monteforte ..... A47C 17/045 5/12.1
4,173,045 A 11/1979 Osborn
4,635,306 A * 1/1987 Willey ..... A47C 16/005 D6/601

(Continued)

FOREIGN PATENT DOCUMENTS

CN 203446933 U 2/2014
CN 211025100 U 7/2020

(Continued)

*Primary Examiner* — Shin H Kim
(74) *Attorney, Agent, or Firm* — Richard M. Goldberg

(57) ABSTRACT

A combination chair and ottoman is adapted to convert to a slide, with the chair having a seat supported directly on a floor; and an ottoman supported directly on the floor in front of the seat, the ottoman including a lower wedge shaped section and an upper wedge shaped section hingedly connected together at common edges thereof, with the upper wedge shaped section adapted to assume a first position on top of the lower wedge shaped section to form the ottoman, and a second position pivoted upwardly on top of the seat while the lower wedge shaped section remains positioned in front of the seat to form a slide; and a first securing arrangement for securing the lower wedge shaped section to the seat when the lower wedge shaped section is positioned in front of the seat.

22 Claims, 14 Drawing Sheets

(56) References Cited

U.S. PATENT DOCUMENTS 4,905,330 A * 3/1990 Jacobs ..... A47C 17/045 5/722
5,086,529 A * 2/1992 DeGroot ..... A47C 27/001 5/725
D376,945 S * 12/1996 Bonaddio ..... D6/601
5,687,742 A * 11/1997 Johnson ..... A61F 5/0585 606/240
5,836,653 A * 11/1998 Albecker ..... A47C 16/005 297/452.32
5,867,849 A * 2/1999 Pontrello ..... A47C 27/15 5/2.1
5,953,779 A * 9/1999 Schwartz ..... A47C 27/144 5/722
D446,676 S * 8/2001 Mayes ..... D6/601
6,270,155 B1 * 8/2001 Rashid ..... A47C 13/00 297/118
7,007,328 B1 * 3/2006 Bailey ..... A47C 16/005 5/640
7,331,074 B2 * 2/2008 Wu ..... A47C 17/045 5/723
D565,131 S * 3/2008 Decker ..... D6/601
D621,628 S * 8/2010 Saul ..... D6/335
D632,503 S * 2/2011 Saul ..... D6/335
8,661,588 B1 * 3/2014 Leach ..... A47D 15/001 5/655
9,108,113 B1 8/2015 Baranov
9,144,318 B1 * 9/2015 Lagier ..... A47C 3/16
D882,296 S * 4/2020 Huang ..... D6/601
D906,705 S * 1/2021 Jang ..... D6/335
11,246,423 B2 * 2/2022 Kulik ..... A47C 17/23
D953,775 S * 6/2022 Setton ..... D6/601
D978,544 S * 2/2023 Fu ..... D6/335
2005/0046243 A1 * 3/2005 Cimino ..... A47C 7/42 297/124
2016/0174715 A1 * 6/2016 Nelson ..... A47C 4/028 297/440.14
2021/0059419 A1 * 3/2021 Kulik ..... A47C 17/32
2022/0053940 A1 * 2/2022 Stamper ..... A47C 17/34

FOREIGN PATENT DOCUMENTS

FR 2616641 B1 3/1990
KR 10-1869343 B1 6/2018
KR 10-2301579 B1 9/2021

* cited by examiner

CHAIR AND ATTACHABLE OTTOMON THAT CONVERTS TO A SLIDE

BACKGROUND OF THE INVENTION

The present invention relates generally to a cushion chair and attachable ottoman that together convert to an amusement slide for children.

U.S. Pat. No. 726,028 discloses a child's exercising and amusement apparatus which includes a chair with rungs 11 between the rear legs adapted to serve as a ladder, and the back of the chair having a large opening 12 above the seat, whereby the child can climb the rungs 11 to get onto the seat of the chair. A slide board 13 is attached to the front of the chair by hinges 14 (FIGS. 1 and 3). The board 13 inclines downward from the hinged end to the floor. Alternatively, as shown in FIGS. 2 and 4, the slide board is attached to the chair by hooks 21, engaging the top rung 22 in the front of the chair.

Although this patent discloses the concept of a chair with a slide, the construction requires a large rigid slide board that has not other purpose than as a slide. If the chair is used alone, the slide board must be disassembled therefrom and stored away. Also, this slide board could not be used with a cushion chair since it must be attached at the top of the front of the seat, and there is no attachment such means with a cushion chair.

U.S. Pat. No. 3,561,757 discloses a hinged modular playground block system. This patent is relevant for its disclosure of block module pairs 14, 15 and 16, 17, wherein the upper module 15 or 16 can be pivoted down to provide a slide. However, there is no indication that this can be used with a chair and ottoman, and there is no indication that both modules 14, 15 can both pivot down or that both modules 16, 17 can both pivot down, to be used as an ottoman.

U.S. Pat. No. 3,736,023 discloses a portable foot stool and lounge chair combination. Specifically, the chair includes cushions A and B superimposed one on top of the other but hinged to each other at a hinge 13, such that cushion A can be pivoted outwardly as shown in FIG. 2A. There are also side arm cushions C and D. Cushions E and F are pivotally mounted to arms C and D by hinges 14 and 15, respectively. It will be appreciated that cushions E and F have a meeting line E'-F' which is an angle to the vertical. Cushion F can be pivoted upwardly to the position shown in FIG. 2A. Cushion G is pivoted to cushion B at hinge 16 and can be pivoted down on top of cushion A as shown in FIG. 2A.

Although this does show pivoting of various cushions, including the formation of a footstool for the chair, it does not provide a slide, and does not provide a combination chair, and ottomon that can convert to a slide.

U.S. Pat. No. 4,173,045 discloses a combination sofa and bed in which the upper cushion 22 is pivoted clockwise in FIG. 2 about hinge 32, and then bolster 18 is hinged about pivot 40, so that the sofa can be used as a bed, as shown in FIGS. 4 and 5. Although this patent shows pivoting cushions, the arrangement fails to disclose a cushion chair with an attached ottoman that converts to a slide.

U.S. Pat. No. 9,108,113 discloses a folding slide in which the different sections 3 are connected to each other by fastening members 5 which permit the sections to slide outwardly relative to each other. However, this fails to disclose a cushion chair with an attached ottoman that converts to a slide.

French Patent No. 2,616,641 discloses a convertible mattress in which there are two cushions 2 and 3 pivoted relative to each other about a pivot 8. In the position shown in FIG. 1, this functions as a conventional mattress with a horizontal planar surface P2. When cushion 2 is pivoted up to the position shown in FIG. 2, it forms an incline with cushion 3 in order to cradle an infant with gastroesophageal reflux. However, there is no indication of use of the mattress as a slide or of one section being used as a slide or ottoman.

Chinese Patent No. 203446933 discloses a back cushion having two parts 20 and 30 which can be arranged as shown in FIGS. 1-3 as a cushion or folded up to the position shown in FIG. 4. However, this fails to disclose a cushion chair with an attached ottoman that converts to a slide.

Korean Patent No. 10-1869343 discloses a multipurpose playing block having one section that can be pivoted down to form a slide at the left side and another section that can be pivoted down at the right side to form steps. A chair having a pivoted down section is stored in the middle and can be pulled out. However, there is no disclosure of the pivoted chair section being formed in two parts in order to form a slide with the chair.

Chinese Patent No. 211025100 discloses a multifunctional combined assembled slide for children which is effectively the same as Korean Patent No. 10-1869343, and the same remarks apply.

Korean Patent No. 10-2301579 discloses a seat with a slide function. In this patent, the different section 30 normally forms part of the seat, but when pivoted down, as shown in FIG. 2, it provides a slide function. However, as shown in FIG. 4, to use the same as a slide function, the entire chair must be turned upside down.

FIGS. 11-14 show an alternative embodiment which can be utilized in two different ways.

In the first way, a reinforcing member 50 has an inclined rectangular member 51 that is separate from and is position on the seat member 20, as shown in FIG. 11. A triangular member 52 is pivotally connected to inclined rectangular member 51 and pivots down to form the slide. When not in use as a slide, the triangular member 52 is pivoted on top of inclined rectangular member 51 to form a block that can be positioned in front of the chair to form a table, as shown in FIG. 12. However, the bottom of the triangular member 52 is positioned coplanar with the bottom of the inclined rectangular member 51. This means that the bottom of the triangular member 52 is coplanar with the upper surface of the seat 20. As a result, this patent requires an additional extension member 30 pivotally attached to the seat 20, which must be outwardly so that triangular member 52 has a support surface, namely, the extension member 30, thereby rendering the arrangement relatively complicated and more expensive. Further, there is no disclosure of utilizing the block as an ottoman or of forming the slide merely by pivoting one section of an ottoman on top of the seat, while the ottoman is still connected to the seat at the front of the seat. Although the reinforcing member 50 can be positioned in front of the seat, because of the height provisions of the slide, the upper surface has too great a height to be used as an ottoman, and in fact, is used as a table, as stated therein, and as such, a recessed table groove 51*a* is provided in inclined rectangular member 51, which would reduce the structural integrity when used as a slide.

In the second way, the reinforcing member 50 is pivotally hinged to the top of the backrest 10 of the chair and can pivot rearwardly down behind the chair to a storage position as shown in FIG. 13, or can pivot down on top of the seat of the chair to form a slide. However, again, there is no disclosure of utilizing the block as an ottoman or of forming the slide merely by pivoting one section of an ottoman on top of the seat, while the ottoman is still connected to the seat at the front of the seat.

SUMMARY OF THE INVENTION

Accordingly, it is an object of the present invention to provide a cushion chair and attachable ottoman that together convert to an amusement slide for children, that overcomes deficiencies in the prior art.

It is another object of the present invention to provide such a cushion chair and attachable ottoman that together convert to an amusement slide for children, while the ottomon is still connected to the front of the chair.

It is still another object of the present invention to provide a cushion chair and attachable ottoman that together convert to an amusement slide for children, in which conversion from a slide to an ottomon, and vice versa, occurs merely by a pivoting action of only one portion of the ottomon, while the ottomon is still connected to the front of the chair.

In accordance with an aspect of the present invention, a combination chair and ottoman that is adapted to convert to a slide, the combination includes a chair having a seat and a seat back, the seat adapted to be supported directly on a floor; and an ottoman adapted to be supported directly on the floor in front of the seat. The ottoman includes a lower wedge shaped section and an upper wedge shaped section hingedly connected together at common edges thereof, with the upper wedge shaped section adapted to assume each of the following positions when the lower wedge shaped section is positioned in front of the seat and directly supported on the floor, namely, a first position on top of the lower wedge shaped section to form the ottoman, and a second position pivoted upwardly on top of the seat while the lower wedge shaped section remains positioned in front of the seat to form a slide. Further, a restraining arrangement is provided for restraining the slide to the seat when the lower wedge shaped section is positioned in front of the seat.

Each of said upper and lower wedge shaped sections includes an upper inclined surface in the second position, with the inclined surfaces being coplanar.

Alternatively, each of said upper and lower wedge shaped sections includes an upper inclined surface in the second position, with the inclined surfaces being one of convex or concave.

The chair further includes side arms that function to restrain said upper wedge shaped section on said seat in the second position.

The restraining arrangement includes a first securement member connected with the lower wedge shaped section and a second securement member connected with the seat for engagement with the first securement member. The first securement member is connected with a bottom surface of the lower wedge shaped section and the second securement member is connected with a bottom surface of the seat, and one of the first and second securement members are movable to the other of the first and second securement members for engagement therewith. Preferably, the first securement member includes one of hooks and loops and the second securement member includes the other of hooks and loops for engagement with the one of hooks and loops when engaged with each other.

A second securing arrangement is provided for securing the upper wedge shaped section to the seat back when the upper wedge shaped section is pivoted upwardly to the position on top of the seat. The second securing arrangement includes a first securement member connected with the upper wedge shaped section and a second securement member connected with the seat back for engagement with the first securement member. Preferably, the first securement member includes one of hooks and loops and the second securement member includes the other of hooks and loops for engagement with the one of hooks and loops.

Alternatively, the restraining arrangement includes interlocking shapes of the seat and slide that engage with each other to restrain movement of the slide on the seat.

A step is secured to a rear surface of the seat back for enabling a child to reach the top of the slide in the second position. The step is removably secured to the rear surface of the seat back. The seat back includes an opening for storing the step when the step is removed from the seat back.

Alternatively, the step is hingedly secured to the rear surface of the seat back by a hinge. In such case, the seat back includes an opening for storing the step when the step is pivoted about the hinge.

In accordance with another aspect of the present invention, an ottoman which is adapted to convert to a slide for use with a chair having a seat and a seat back, includes a lower wedge shaped section adapted to be supported directly on the floor in front of the seat; and an upper wedge shaped section hingedly connected together with the lower wedge shaped section at common edges thereof. The upper wedge shaped section is adapted to assume each of the following positions when the lower wedge shaped section is supported directly on the floor in front of the seat, namely, a first position on top of the lower wedge shaped section to form the ottoman, and a second position pivoted upwardly on top of the seat while the lower wedge shaped section remains positioned in front of the seat to form a slide. A first securing arrangement is provided for securing the lower wedge shaped section to the seat when the lower wedge shaped section is positioned in front of the seat.

Each of the upper and lower wedge shaped sections includes an upper inclined surface in the second position, with the inclined surfaces being coplanar.

A second securing arrangement is provided for securing the upper wedge shaped section to the seat back when the upper wedge shaped section is pivoted upwardly to the position on top of the seat.

In accordance with still another aspect of the present invention, a method is provided for converting an ottoman to a slide for use with a chair adapted to be supported directly on a floor, the chair having a seat and a seat back, the ottoman having a lower wedge shaped section and an upper wedge shaped section hingedly connected together with the lower wedge shaped section at common edges thereof. The method includes the steps of positioning the ottoman with the upper wedge shaped section positioned on top of the lower wedge shaped section, such that the lower wedge shaped section sits directly on the floor in front of the seat; restraining the lower wedge shaped section to the seat when the lower wedge shaped section is positioned in front of the seat; and pivoting the upper wedge shaped section relative to the lower wedge shaped section around the common edges thereof when the lower wedge shaped section is restrained to the seat so that the upper wedge shaped section rests on top of the seat while the lower wedge shaped section remains positioned in front of the seat, to form a slide.

The method further includes the step of securing the upper wedge shaped section to the seat back when the upper wedge shaped section is pivoted upwardly to the position on top of the seat.

The method further includes the step of removably securing a step to a rear surface of the seat back.

The above and other objects, features and advantages of the invention will become readily apparent from the following detailed description thereof which is to be read in connection with the accompanying drawings.

DETAILED DESCRIPTION

Figure 2:
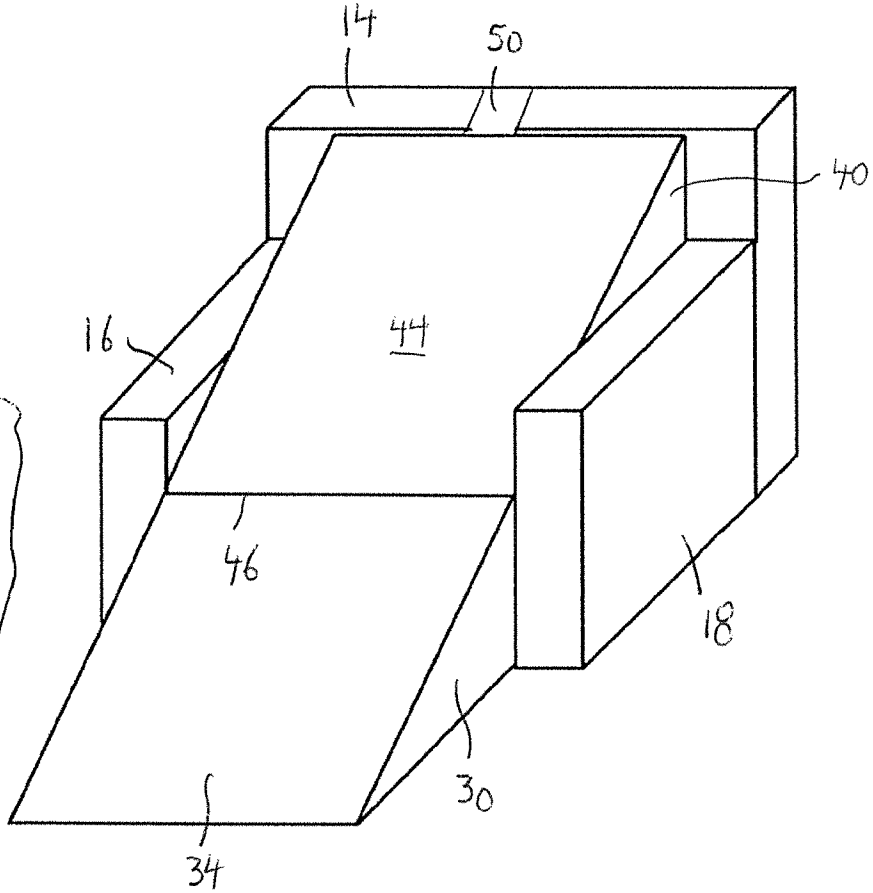
FIG. 2 is a front perspective view showing the chair with the ottomon converted to a slide.
Figure 1:
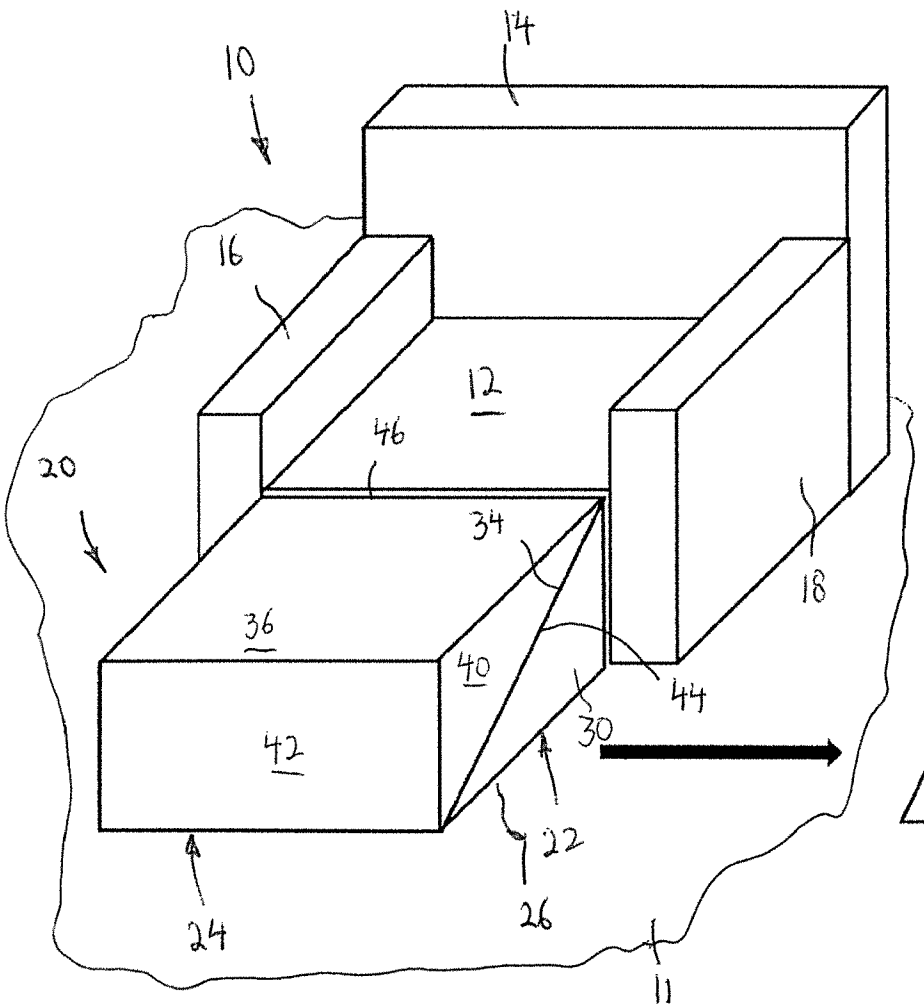
FIG. 1 is a front perspective view showing the chair with the ottomon positioned in front of the chair.

Referring to the drawings in detail, and initially to FIGS. 1 and 2, a chair 10 according to the present invention, which is supported on a floor 11, includes a seat 12, a seat back 14 extending upwardly from the floor at the rear of the seat 12, and left and right arm rests 16 and 18 extending upwardly from the floor at left and right sides of the seat 12. Left and right arm rests 16 and 18 each extend from the front face of the seat back 14 to the front edge of seat 12. Preferably, seat 12 is formed as a cushion seat although the present invention is not limited thereby.

An ottoman 20 is positioned in front of seat 12 and has a generally rectangular parallelepiped shape, and is also positioned directly on floor 11. Ottoman 20 is formed by two wedge shaped sections 22 and 24 connected together at a common edge so that sections 22 and 24 can pivot relative to each other.

Specifically, as shown best in FIGS. 1-6, when in the ottoman configuration, lower wedge shaped section 22 includes a square or rectangular bottom surface 26 which rests on the floor 11 in front of seat 12, two triangular side surfaces 28 and 30 that extend upwardly from left and right side edges of bottom surface 26 and are inclined upwardly front to rear, a rectangular rear surface 32 that is connected between the rear edge of bottom surface 26 and the rear edges of triangular side surfaces 28 and 30. Finally, an upper square or rectangular inclined surface 34 is connected between the top edge of rear surface 32 and the front edge of bottom surface 26, and is also connected to the top inclined edges of triangular side surfaces 28 and 30. It will therefore be appreciated that upper surface 34 is inclined downwardly from the rear edge thereof to the front edge thereof, that is, in a direction away from chair 10.

In like manner, when in the ottoman configuration of FIG. 1, upper wedge shaped section 24 includes an upper square or rectangular surface 36, two triangular side surfaces 38 and 40 that extend downwardly from left and right side edges of surface 36, a rectangular front facing surface 42 that is connected between the front edge of upper surface 36 and the front edges of triangular side surfaces 38 and 40. Finally, a lower square or rectangular inclined surface 44 is connected between the bottom edge of front facing surface 42 and the rear edge of upper surface 36, and is also connected to the bottom inclined edges of triangular side surfaces 38 and 40. It will therefore be appreciated that lower surface 44 is inclined downwardly from the rear edge thereof to the front edge thereof.

Further, the rear edges of inclined surfaces 34 and 44 are connected together along a hinge line 46 so that they can be pivoted relative to each other.

Thus, in FIG. 1, inclined surface 44 rests on inclined surface 34 so that together, wedge shaped sections 22 and 24 together form a rectangular parallelepiped configuration to function as an ottoman, whereby a person seated on seat 12 can place his or her feet on surface 36.

It will be appreciated that the height of rectangular rear section 32 of lower wedge shaped section 22 is substantially equal to the height of seat 12. Further, the width of each wedge shaped section 22 and 24 is substantially the same as the width of seat 12.

Figure 4:
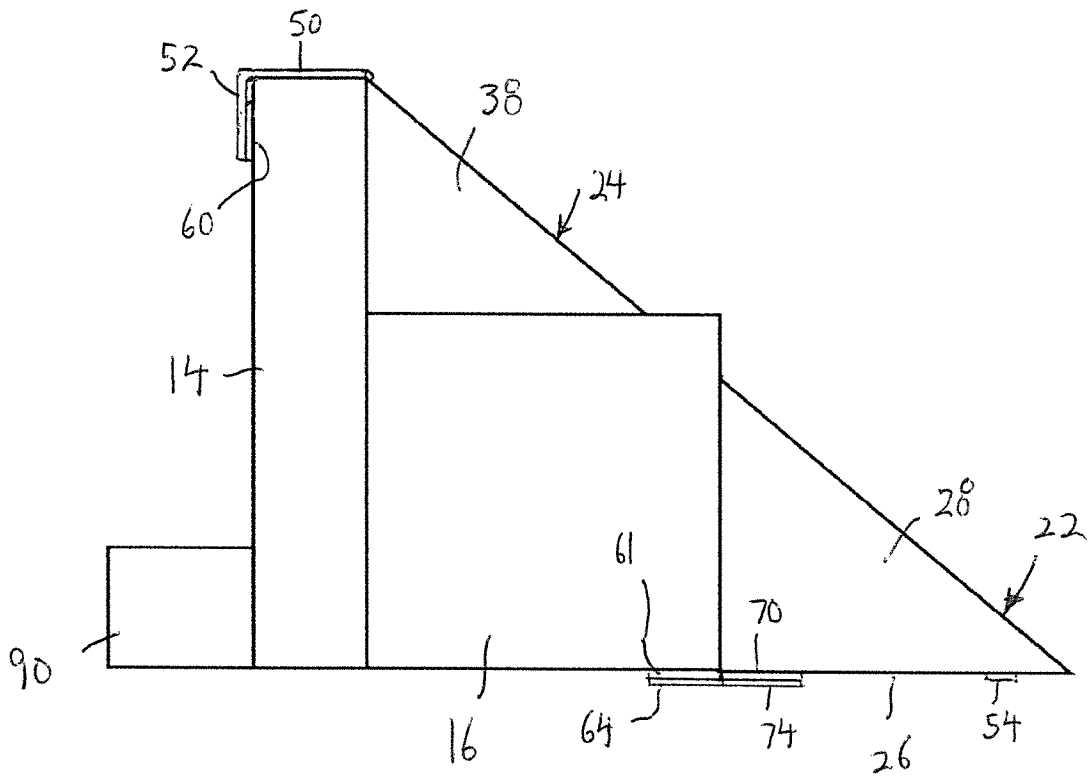
FIG. 4 is a side elevational view of the chair and slide of FIG. 2.
Figure 5:
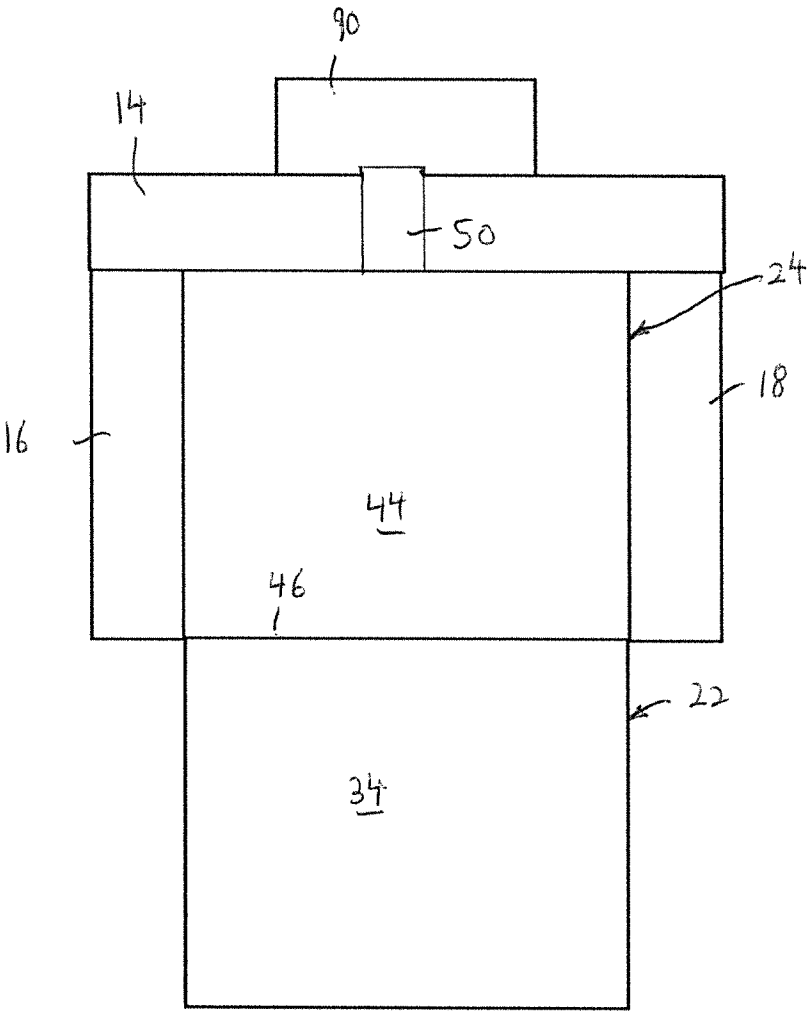
FIG. 5 is a top plan view of the chair and slide of FIG. 2.
Figure 6:
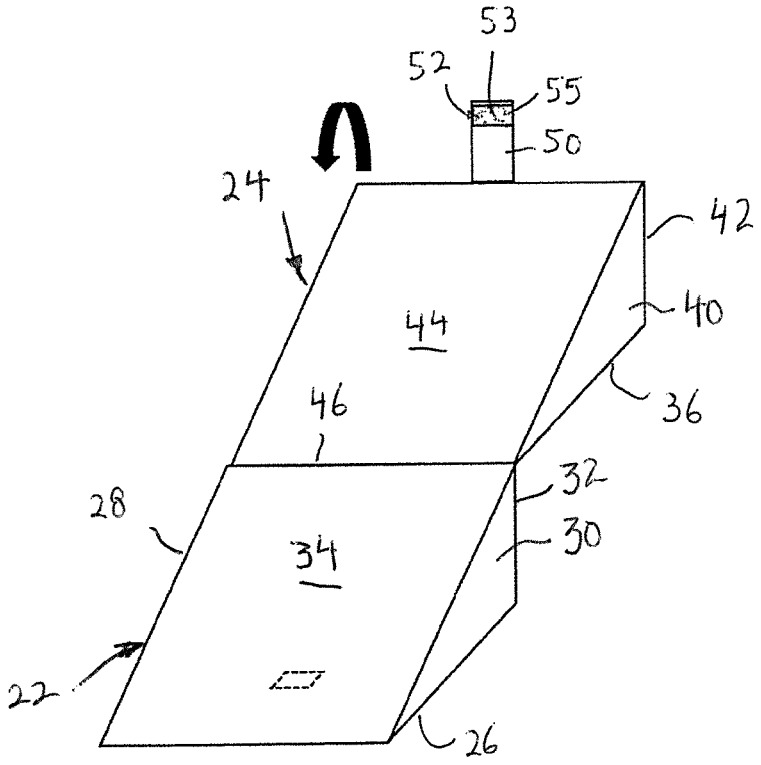
FIG. 6 is a perspective view of the ottomon alone in its slide configuration.

When it is desired to convert the ottoman to a slide, it is merely necessary to pivot upper wedge shaped section 24 about hinge line 46 such that upper rectangular surface 36 is inverted and sits on the upper surface of seat 12, as shown in FIGS. 2, 4 and 5. In such case, upper rectangular surface 36 becomes a lower surface, and lower inclined surface 44 is inverted and becomes an upper inclined surface that forms a continuation of upper inclined surface 34 of lower wedge shaped section 22, that is, inclined surfaces 34 and 44 become coplanar at the same inclination angle.

Alternatively, one or both of inclined surfaces 34 and 44 can have a slight convex or concave curvature, rather than the surfaces being coplanar.

Further, as shown in FIG. 2, front facing surface 42 now faces rearwardly and abuts against the front facing surface of seat back 14.

Also, in the slide configuration of FIG. 2, wedge shaped section 24 is restrained between left and right arm rests 16 and 18 for further stability.

It will be appreciated that, in such slide configuration, the top of the slide is substantially flush or even with the top of the seat back 14.

Figure 3:
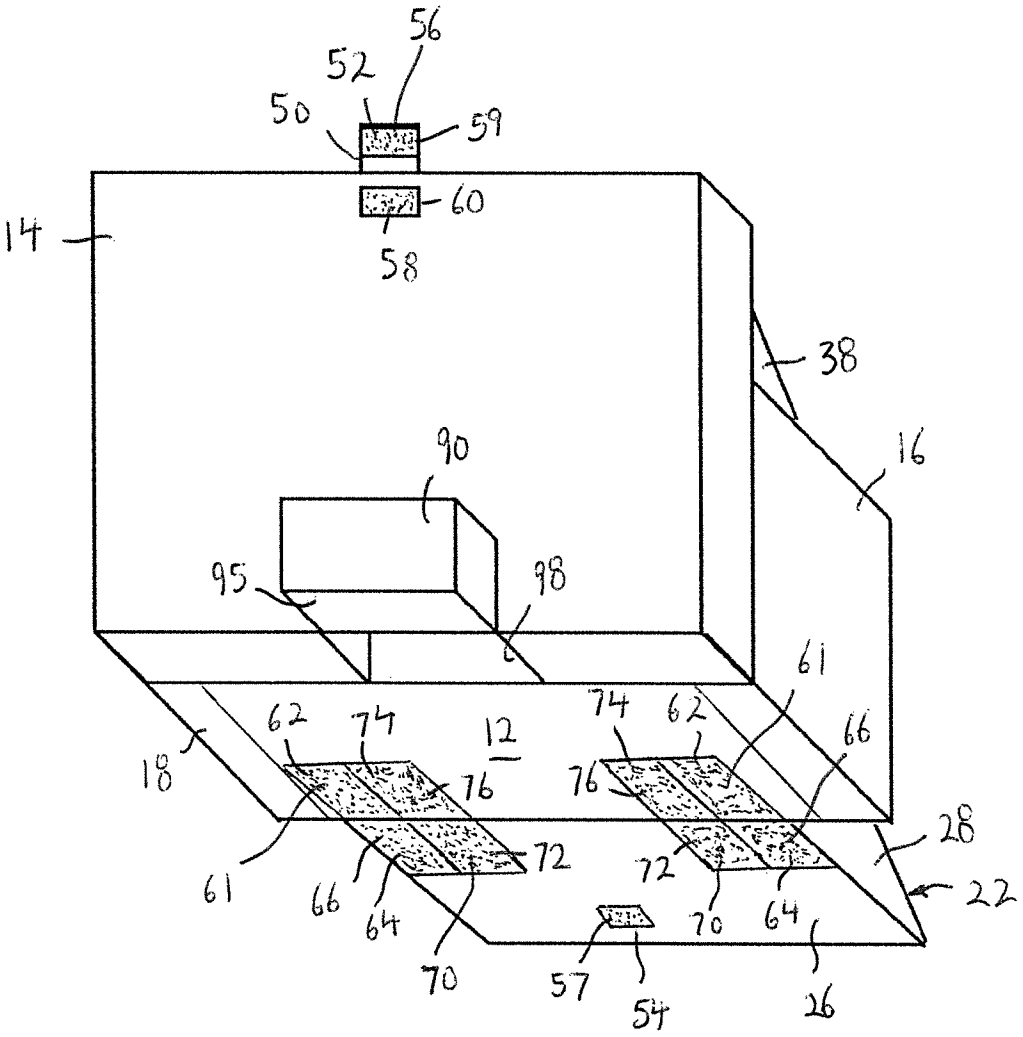
FIG. 3 is a rear perspective view of the chair and slide of FIG. 2.

In order to restrain wedge shaped sections 22 and 24 in the ottoman configuration of FIG. 1, a flexible fabric tab 50 has one end connected centrally to the lower edge of front facing surface 42. The free end portion 52 of tab 50 includes either small hooks or loops (not shown) 53 on a first surface 55 thereof, and a small fabric section 54 adhered to bottom surface 26, as shown in FIG. 3, includes the other of small hooks or loops 57 for engaging with the small hooks or loops 53 of the tab 50, to prevent pivoting of wedge shaped section 24 relative to wedge shaped section 22. The arrangement of hooks and loops is commonly sold under the trademark VELCRO.

In like manner, to prevent movement of the slide on chair 10 when in use, flexible fabric tab 50 also includes small hooks or loops 56 on the second, opposite side 59 of free end portion 52, as shown best in FIG. 3, for engaging with the other of small hooks or loops 58 on a small fabric section 60 adhered to the rear surface of seat back 14 at the upper end thereof.

To further prevent movement of the slide on chair 10 when in use, as shown in FIG. 3, the lower surface of seat 12 includes two rectangular pieces of fabric 61 fixedly secured at opposite sides thereof, with each piece of fabric 61 including one of said hooks or loops 62. Two rectangular pieces of fabric 64 are hingedly secured to bottom surface 26 only at the rear edge of bottom surface 26. Each piece of fabric 64 includes the other of hooks or loops 66. In this manner, each piece of fabric 64 can be pivoted to be in overlapping relation to the respective piece of fabric 61 so that the hooks and loops engage each other to secure lower wedge shaped section 22 to seat 12. The arrangement of hooks and loops is commonly sold under the trademark VELCRO.

In like manner, bottom surface 26 includes two rectangular pieces of fabric 70 fixedly secured at opposite sides thereof, with each piece of fabric 70 including one of said hooks or loops 72. Two rectangular pieces of fabric 74 are hingedly secured to the lower surface of seat 12 only at the front edge of seat 12. Each piece of fabric 74 includes the other of hooks or loops 76. In this manner, each piece of fabric 74 can be pivoted to be in overlapping relation to her respective piece of fabric 70 so that the hooks and loops engage each other to secure lower wedge shaped section 22 to seat 12. The arrangement of hooks and loops is commonly sold under the trademark VELCRO.

Figure 10:
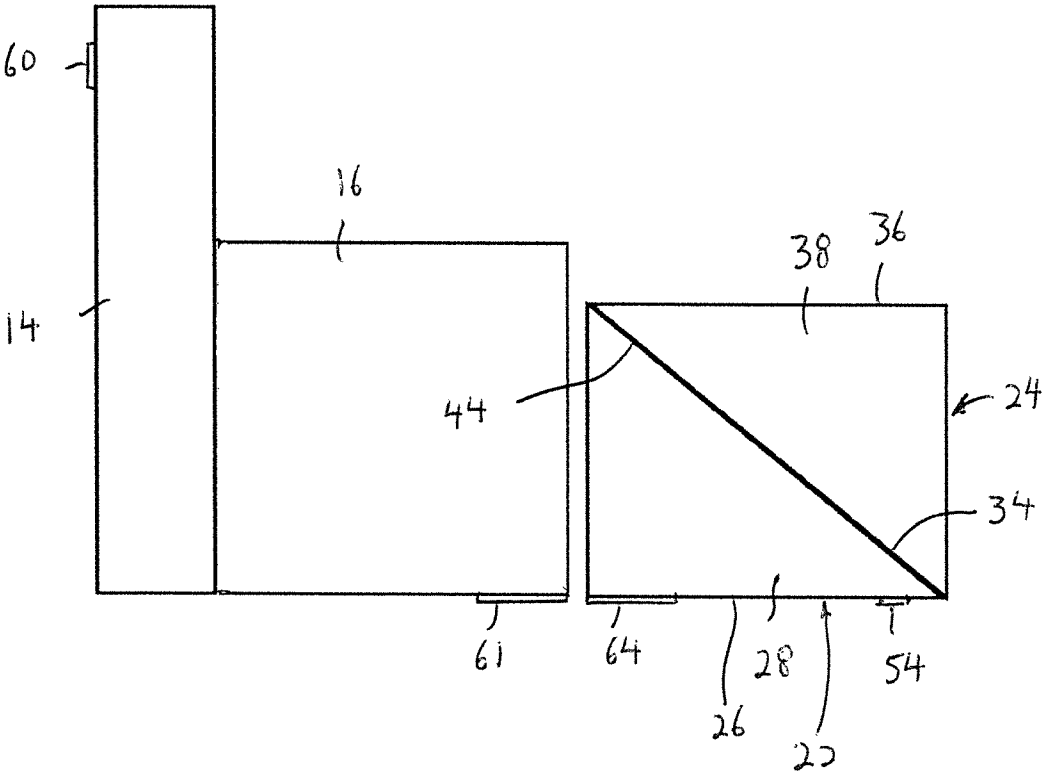
FIG. 10 is a side elevational view of the chair with the ottomon positioned in front of the chair and the ottomon detached from the chair.
Figure 11:
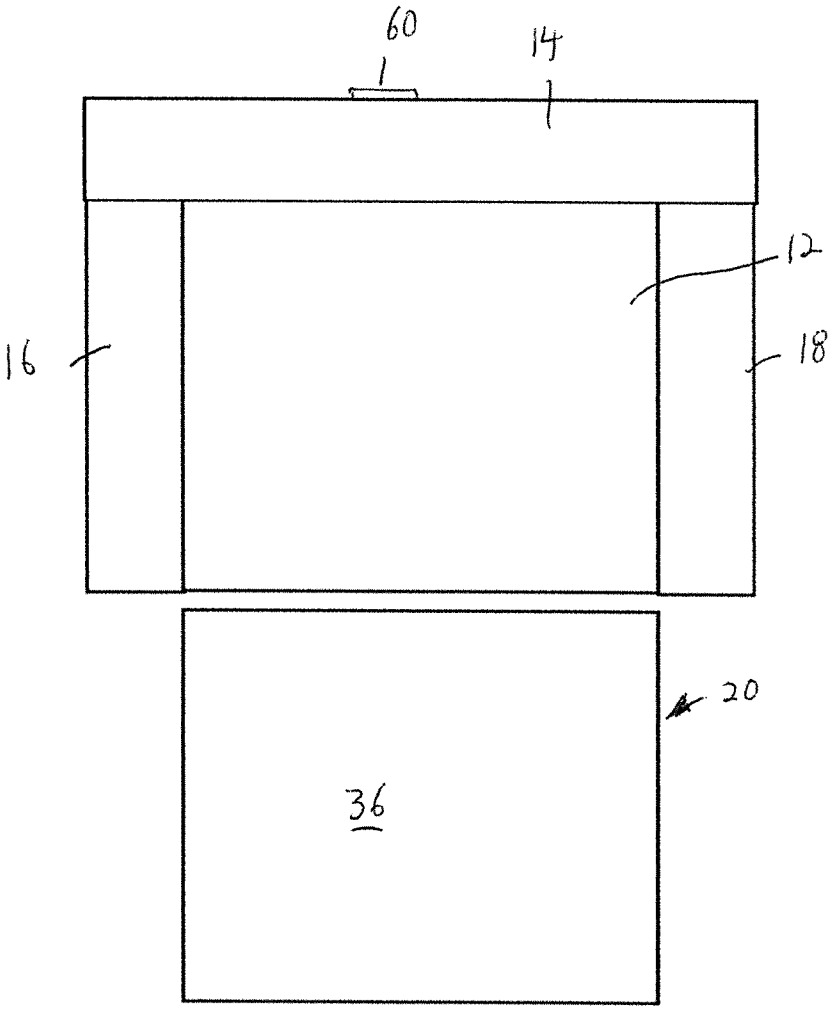
FIG. 11 is a top plan view of the chair with the ottomon of FIG. 10.

It will be appreciated that, when used as an ottoman, pieces of fabric 61, 64, 70 and 74 can be disconnected from each other, so that the ottoman can be moved away from chair 10, as shown in FIGS. 10 and 11.

Figure 7:
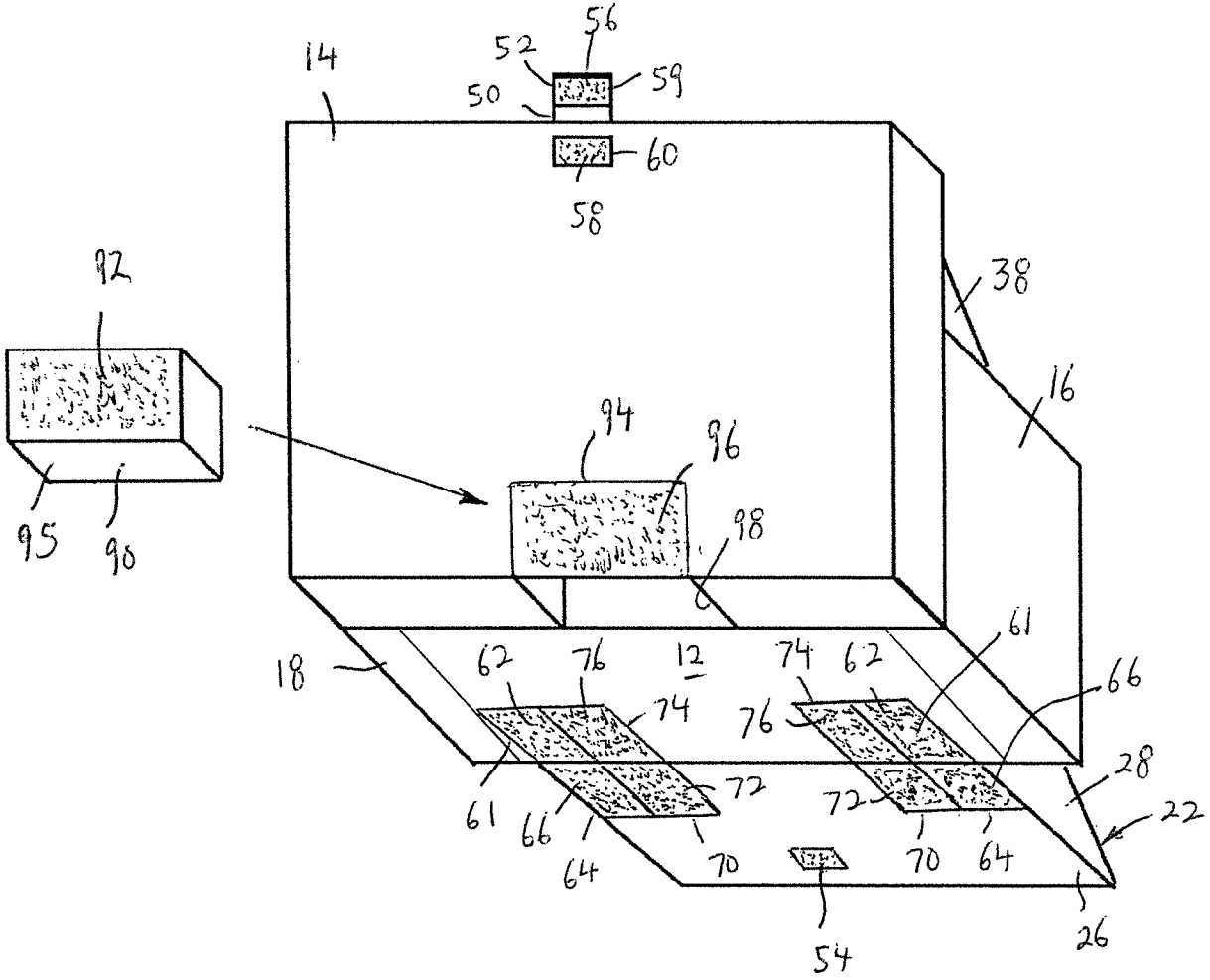
FIG. 7 is a rear perspective view of the chair and slide of FIG. 2, with the rear step removed.

In order to aid a child to climb to the top of the slide at the upper edge of seat back 14, as shown in FIG. 3, in order to slide down the slide, a rectangular parallelepiped step 90 is provided at the rear surface of seat back 14. As shown in FIG. 7, step 90 includes one of hooks and loops 92 on one surface thereof, and a piece of fabric 94 which is secured to the rear surface of seat back 14 includes the other of hooks and loops 96 so that step 90 can be removably secured to the rear surface of seat back 14. In such case, the bottom surface 95 of step 90 sits on the floor. The arrangement of hooks and loops is commonly sold under the trademark VELCRO.

Figure 8:
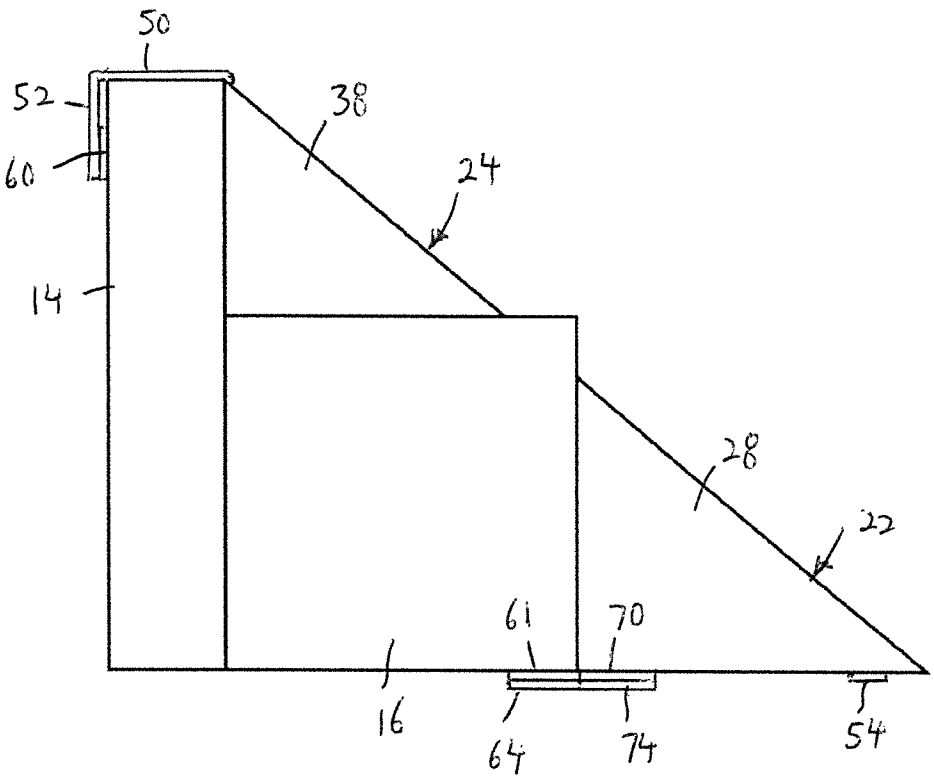
FIG. 8 is a side elevational view of the chair and slide of FIG. 7.
Figure 9:
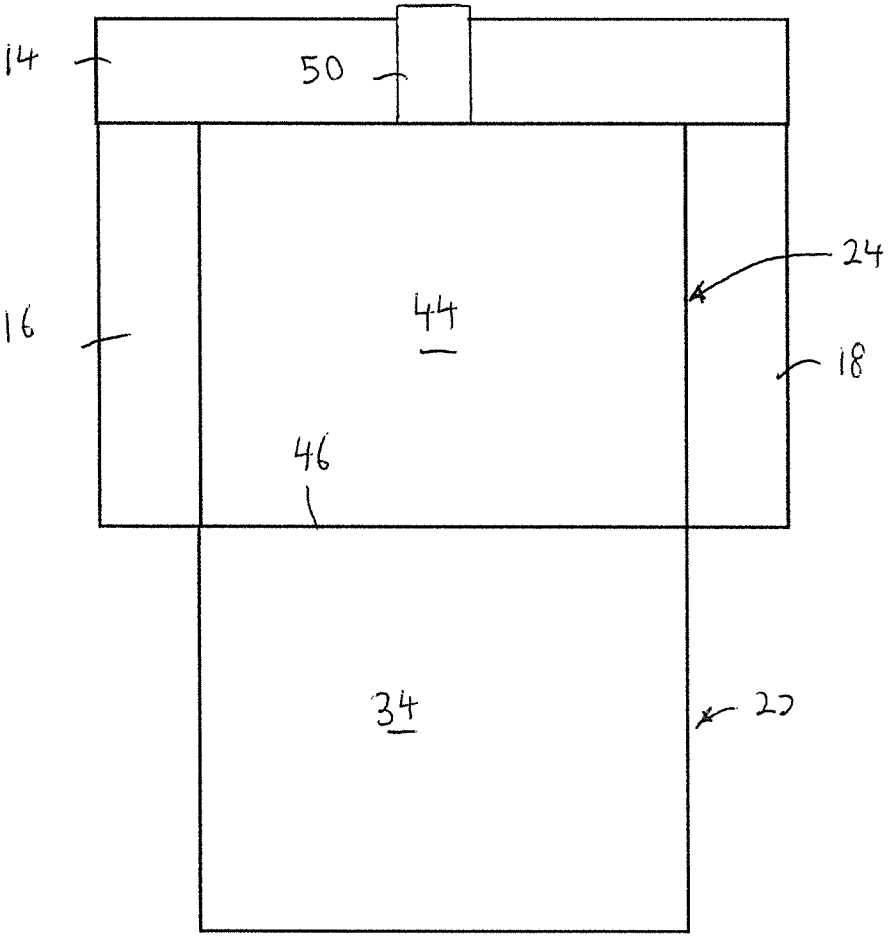
FIG. 9 is a top plan view of the chair and slide of FIG. 7.

When the arrangement is not used as a slide, but rather, as an ottoman, step 90 can be removed from seat back 14, and stored within seat back 14 in an opening 98 (FIG. 3) provided at the lower end of seat back 14, as shown in FIGS. 8 and 9.

Figure 13:
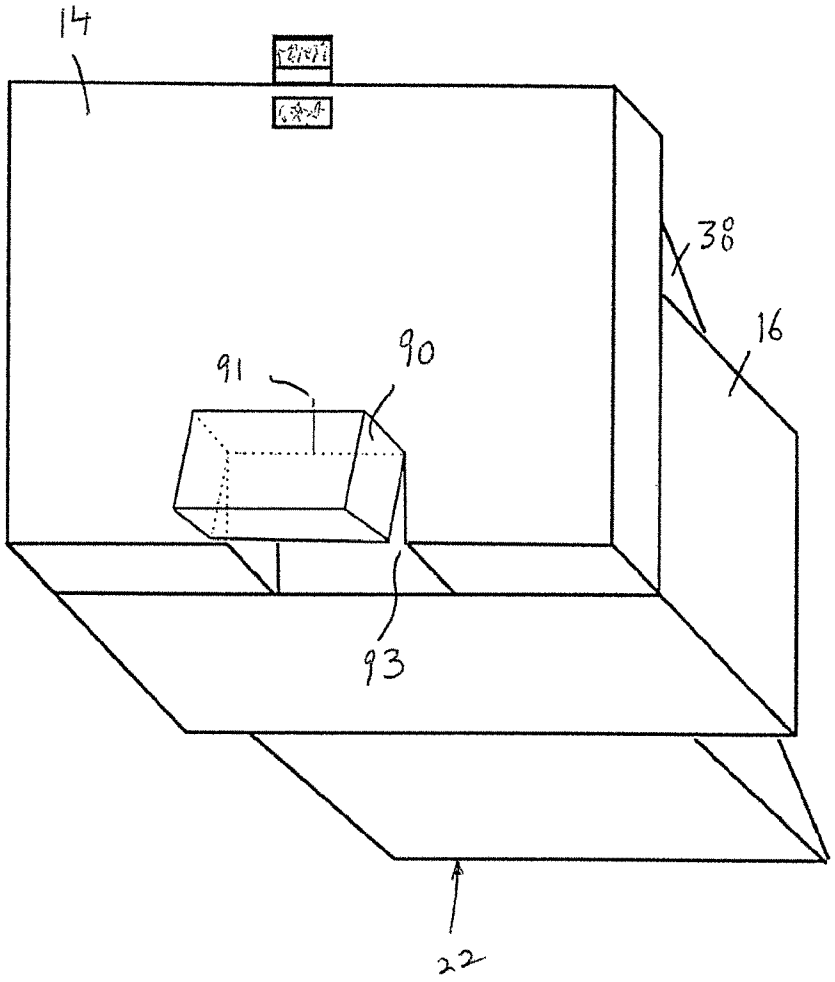
FIG. 13 is a rear perspective view of the arrangement of FIG. 12, showing the hinged nature of stepped.
Figure 12:
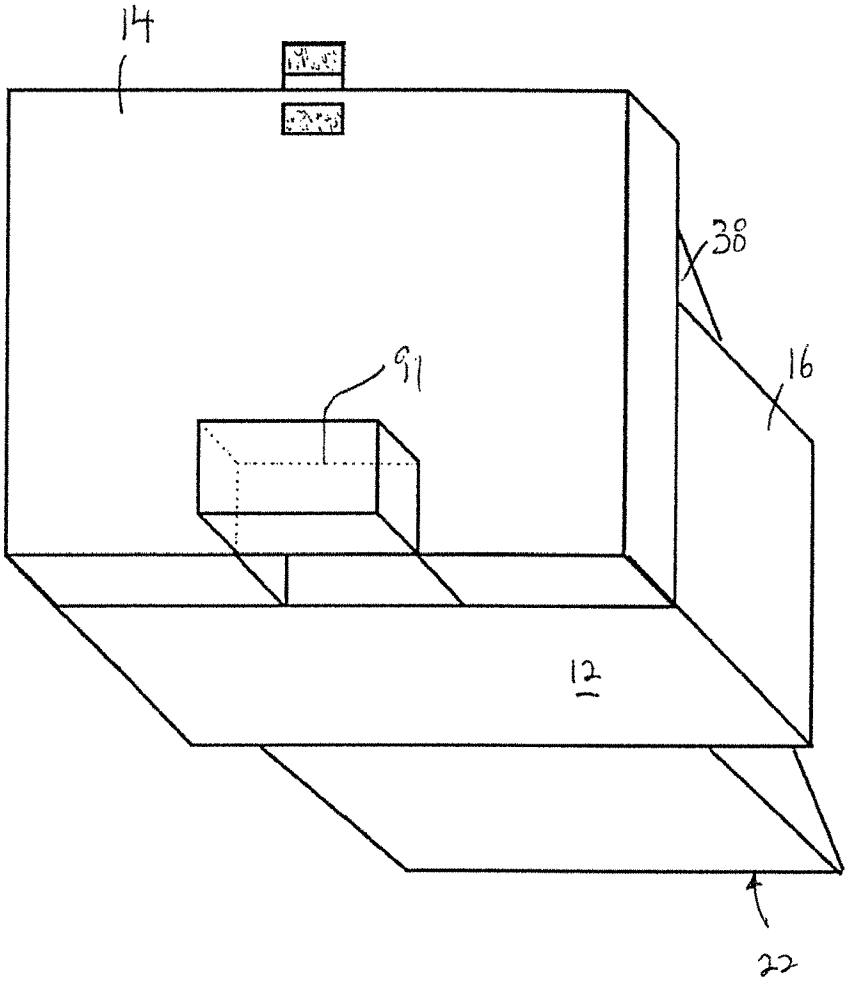
FIG. 12 is a rear perspective view of the chair and slide of FIG. 2 with a modification of the step.

Alternatively, as shown in FIGS. 12 and 13, step 90 can be secured to the rear of seat back 14 by a hinge 91 at the upper edge thereof, in covering relation to an opening 93 in seat back 14. In the position shown in FIG. 12, the bottom of step 90 rests on the floor to support a child climbing up the back of the chair. When not in use, step 90 can be pivoted about hinge 91 two opening 93 for the storage, and thereby also closing off opening 93.

It will be appreciated that various modifications can be made to the present invention within the scope of the claims. For example, in place of the VELCRO arrangements discussed above, other securing means can be used such as snaps, ties, zippers, buckles and the like.

As another alternative, a restraining arrangement can be provided, for example, seat 12 can have a slight depression and surface 36 can be slightly convex to fit within the depression so as to prevent movement of the ottoman when converted to the slide configuration. It will be appreciated that other complementary shapes, other than convex and concave, can be used to provide such restraining arrangement.

Figure 14:
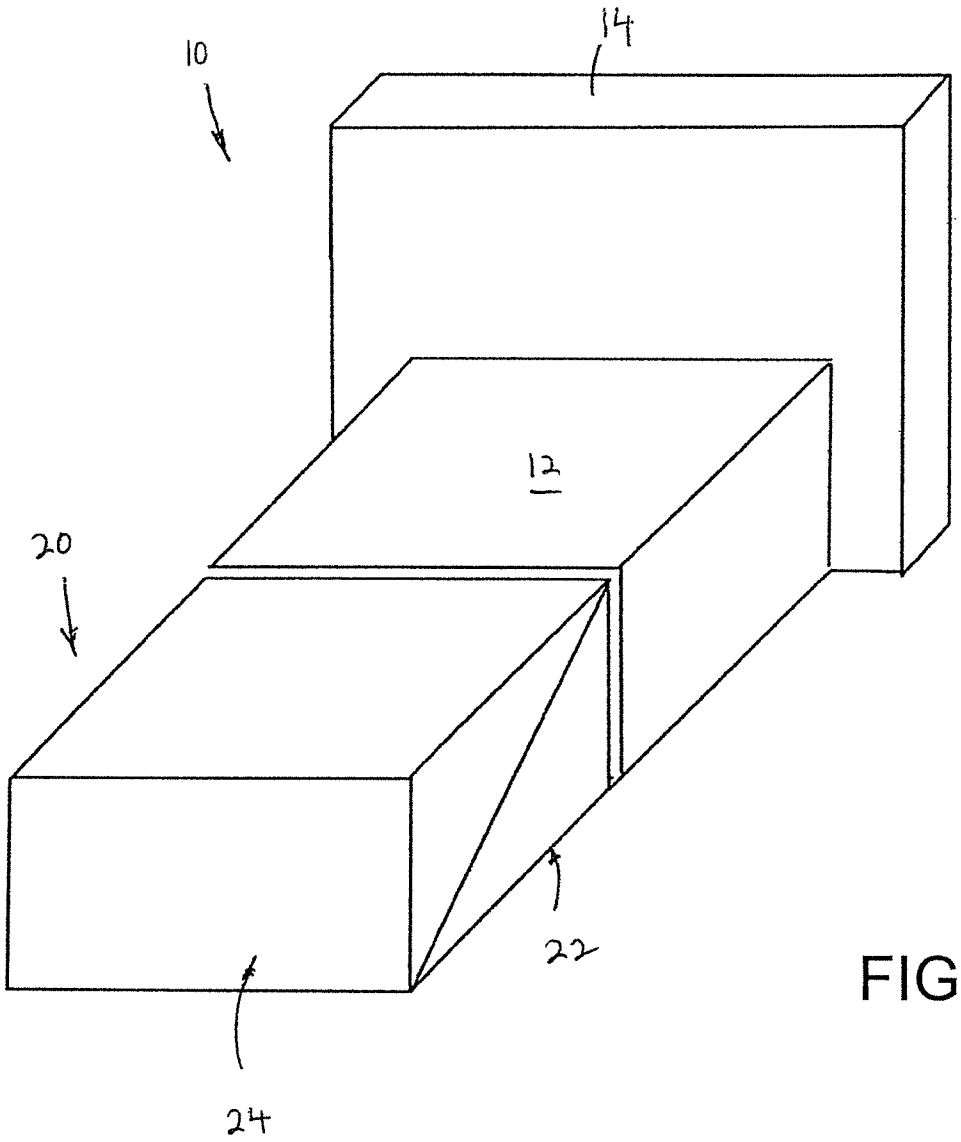
FIG. 14 is a front perspective view showing the chair with the ottomon positioned in front of the chair, but without any arms.
Figure 15:
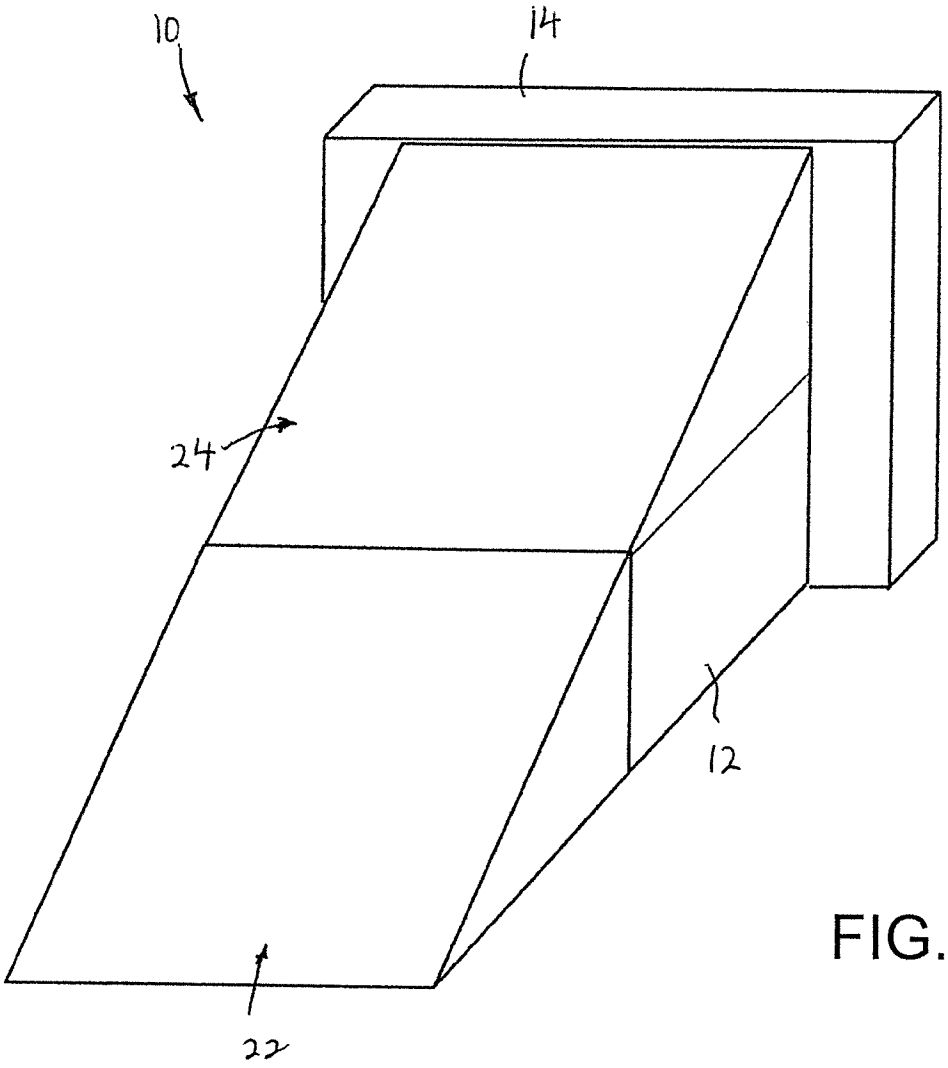
FIG. 15 is a front perspective view showing the chair of FIG. 12, with the ottomon converted to a slide.
Figure 16:
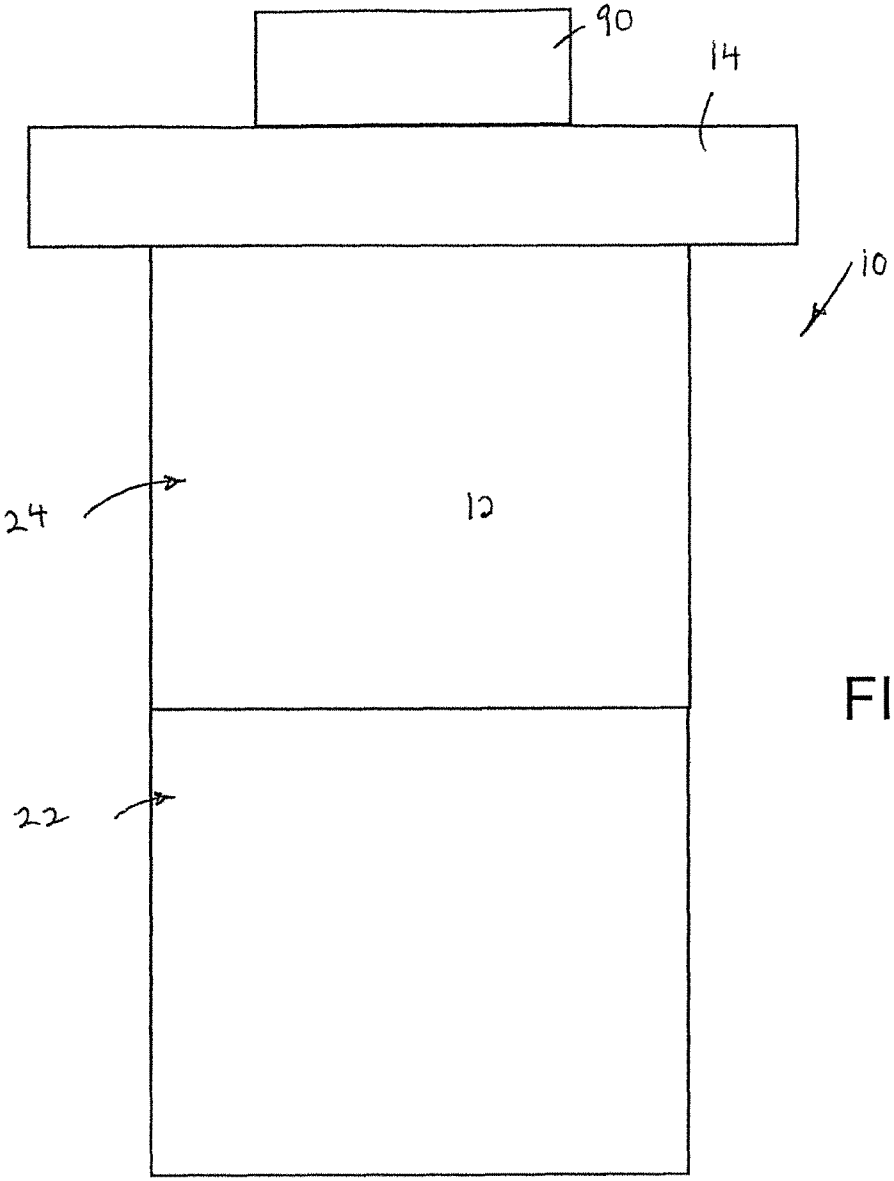
FIG. 16 is a top plan view of the chair and slide of FIG. 13.

It will be appreciated that, although the present invention has been discussed in relation to a chair with arms 16 and 18, the present invention is not so limited. Specifically, the slide of the present invention can be used with a chair having no arms, as shown in FIGS. 14-16.

Having described a specific preferred embodiment of the invention with reference to the accompanying drawings, it will be appreciated that the present invention is not limited to that precise embodiment and that various changes and modifications can be effected therein by one of ordinary skill in the art without departing from the scope or spirit of the invention as defined by the appended claims.

What is claimed is:

1. A combination chair and ottoman that is adapted to convert to a slide, the combination comprising:

a chair having a seat and a seat back, the chair adapted to be supported directly on a floor;

an ottoman adapted to be supported directly on the floor in front of the seat, the ottoman including a lower wedge shaped section and an upper wedge shaped section hingedly connected together at common edges thereof, with the upper wedge shaped section adapted to selectively assume each of the following positions when the lower wedge shaped section is positioned in front of the seat and directly supported on the floor:

a first position on top of the lower wedge shaped section to form the ottoman, or a second position pivoted upwardly on top of the seat while the lower wedge shaped section remains positioned in front of the seat such that the lower wedge shaped section and the upper wedge shaped section together form a slide with each of said upper and lower wedge shaped sections including an upper inclined surface in the second position that together form an upper surface of the slide that is inclined relative to the floor on which the chair is supported; and a restraining arrangement for releasably restraining the slide to the chair when the lower wedge shaped section is positioned in front of the seat.

2. The combination chair and ottoman that is adapted to convert to a slide, according to claim 1, wherein the upper inclined surfaces of said upper and lower wedge shaped sections in the second position, are coplanar.

3. The combination chair and ottoman that is adapted to convert to a slide, according to claim 1, wherein the upper inclined surfaces of said upper and lower wedge shaped sections in the second position, being one of convex or concave.

4. The combination chair and ottoman that is adapted to convert to a slide, according to claim 1, wherein the chair further includes side arms that function to restrain said upper wedge shaped section on said seat in the second position.

5. The combination chair and ottoman that is adapted to convert to a slide, according to claim 1, wherein said restraining arrangement includes a first securing arrangement having a first securement member connected with the lower wedge shaped section and a second securement member connected with the chair for releasable engagement with the first securement member.

6. The combination chair and ottoman that is adapted to convert to a slide, according to claim 5, wherein said first securement member is connected with a bottom surface of the lower wedge shaped section and said second securement member is connected with a bottom surface of the chair, and one of said first and second securement members are movable to the other of said first and second securement members for releasable engagement therewith.

7. The combination chair and ottoman that is adapted to convert to a slide, according to claim 5, wherein said first securement member includes one of hooks and loops and the second securement member includes the other of hooks and loops for releasable engagement with said one of hooks and loops when engaged with each other.

8. The combination chair and ottoman that is adapted to convert to a slide, according to claim 1, wherein the restraining arrangement includes a securing arrangement for securing the upper wedge shaped section to the seat back when the upper wedge shaped section is pivoted upwardly to the position on top of the seat.

9. The combination chair and ottoman that is adapted to convert to a slide, according to claim 8, wherein said securing arrangement includes a first securement member connected with the upper wedge shaped section and a second securement member connected with the seat back for engagement with the first securement member.

10. The combination chair and ottoman that is adapted to convert to a slide, according to claim 9, wherein said first securement member includes one of hooks and loops and the second securement member includes the other of hooks and loops for engagement with said one of hooks and loops.

11. The combination chair and ottoman that is adapted to convert to a slide, according to claim 1, wherein said restraining arrangement includes interlocking shapes of said seat and slide that engage with each other to restrain movement of the slide on the seat.

12. A combination chair and ottoman that is adapted to convert to a slide, the combination comprising:

a chair having a seat and a seat back, the seat adapted to be supported directly on a floor;

an ottoman adapted to be supported directly on the floor in front of the seat, the ottoman including a lower wedge shaped section and an upper wedge shaped section hingedly connected together at common edges thereof, with the upper wedge shaped section adapted to assume each of the following positions when the lower wedge shaped section is positioned in front of the seat and directly supported on the floor:

a first position on top of the lower wedge shaped section to form the ottoman, or a second position pivoted upwardly on top of the seat while the lower wedge shaped section remains positioned in front of the seat to form a slide;

a restraining arrangement for restraining the slide to the seat when the lower wedge shaped section is positioned in front of the seat; and a step secured to a rear surface of said seat back for enabling a child to reach the top of the slide in the second position.

13. The combination chair and ottoman that is adapted to convert to a slide, according to claim 12, wherein said step is removably secured to said rear surface of said seat back.

14. The combination chair and ottoman that is adapted to convert to a slide, according to claim 13, wherein said seat back includes an opening for storing said step when said step is removed from said seat back.

15. The combination chair and ottoman that is adapted to convert to a slide, according to claim 12, wherein said step is hingedly secured to said rear surface of said seat back by a hinge.

16. The combination chair and ottoman that is adapted to convert to a slide, according to claim 13, wherein said seat back includes an opening for storing said step when said step is pivoted about said hinge.

17. An ottoman adapted to convert to a slide for use with a chair having a seat and a seat back, the ottoman comprising:

a lower wedge shaped section adapted to be supported directly on the floor in front of the seat; and an upper wedge shaped section hingedly connected together with the lower wedge shaped section at common edges thereof, with the upper wedge shaped section adapted to selectively assume each of the following positions when the lower wedge shaped section is supported directly on the floor in front of the seat:

a first position on top of the lower wedge shaped section to form the ottoman, or a second position pivoted upwardly on top of the seat while the lower wedge shaped section remains positioned in front of the seat such that the lower wedge shaped section and the upper wedge shaped section together form a slide with each of said upper and lower wedge shaped sections including an upper inclined surface in the second position that together form an upper surface of the slide that is inclined relative to the floor on which the chair is supported; and a first securing arrangement for releasably securing the lower wedge shaped section to the chair when the lower wedge shaped section is positioned in front of the seat.

18. The ottoman according to claim 17, wherein the upper inclined surfaces of said upper and lower wedge shaped sections in the second position, are coplanar.

19. The ottoman according to claim 17, further comprising a second securing arrangement for securing the upper wedge shaped section to the seat back when the upper wedge shaped section is pivoted upwardly to the position on top of the seat.

20. A method of converting an ottoman to a slide for use with a chair adapted to be supported directly on a floor, the chair having a seat and a seat back, the ottoman having a lower wedge shaped section and an upper wedge shaped section hingedly connected together with the lower wedge shaped section at common edges thereof, the method comprising the steps of:

positioning the ottoman with the upper wedge shaped section positioned on top of the lower wedge shaped section, such that the lower wedge shaped section sits directly on the floor in front of the chair, releasably restraining the lower wedge shaped section to the chair when the lower wedge shaped section is positioned in front of the seat; and pivoting the upper wedge shaped section relative to the lower wedge shaped section around the common edges thereof when the lower wedge shaped section is restrained to the seat such that the upper wedge shaped section rests on top of the seat while the lower wedge shaped section remains positioned in front of the seat, such that the lower wedge shaped section and the upper wedge shaped section together form a slide with each of the upper and lower wedge shaped sections including an upper inclined in the second position that together form an upper surface of the slide that is inclined relative to the floor on which the chair is supported.

21. The method according to claim 20, further comprising the step of securing the upper wedge shaped section to the seat back when the upper wedge shaped section is pivoted upwardly to the position on top of the seat.

22. The method according to claim 20, further comprising the step of removably securing a step to a rear surface of said seat back.

* * * * *